US011175089B2

(12) United States Patent
Marinello et al.

(10) Patent No.: US 11,175,089 B2
(45) Date of Patent: Nov. 16, 2021

(54) FLEXIBLE PASSTHROUGH INSULATION FOR VIS

(71) Applicant: WHIRLPOOL CORPORATION, Benton Harbor, MI (US)

(72) Inventors: Giulia Marinello, St. Joseph, MI (US); Rafael D. Nunes, St. Joseph, MI (US); Sanjesh Kumar Pathak, Stevensville, MI (US); Manoj T. Sambrekar, Maharashtra (IN); Arpit Vijay, Rajasthan (IN)

(73) Assignee: Whirlpool Corporation, Benton Harbor, MI (US)

( * ) Notice: Subject to any disclaimer, the term of this patent is extended or adjusted under 35 U.S.C. 154(b) by 28 days.

(21) Appl. No.: 16/718,269

(22) Filed: Dec. 18, 2019

(65) Prior Publication Data

US 2021/0190413 A1 Jun. 24, 2021

(51) Int. Cl.
*F25D 23/06* (2006.01)

(52) U.S. Cl.
CPC .... *F25D 23/061* (2013.01); *F25D 2201/1262* (2013.01); *F25D 2400/40* (2013.01)

(58) Field of Classification Search
CPC ..... F25D 23/061; F25D 23/068; F25D 23/08; F25D 2201/1262; F25D 2400/40; F25B 39/00; F25B 49/027
See application file for complete search history.

(56) References Cited

U.S. PATENT DOCUMENTS 1,830,060 A 11/1931 Holbrook
2,311,427 A * 2/1943 Winkelmeyer ..... H02G 3/0616 16/108
2,459,370 A 1/1949 Ferguson et al.
2,517,717 A * 8/1950 Rose ..... F16L 5/14 285/192
2,783,065 A 2/1957 Martin
2,922,836 A 1/1960 Brown
3,167,931 A * 2/1965 Bryson ..... F25D 17/047 62/277
3,424,857 A 1/1969 Miller et al.
3,572,049 A * 3/1971 Moorman ..... F25D 27/00 62/132
3,580,988 A * 5/1971 Orlowski ..... H02G 3/0616 174/153 G
3,681,947 A * 8/1972 Cowan ..... D06F 39/10 68/18 F (Continued)

FOREIGN PATENT DOCUMENTS

EP 2778582 A2 9/2014
JP 2004190880 A * 4/2000

(Continued)

*Primary Examiner* — Hanh V Tran
(74) *Attorney, Agent, or Firm* — Price Heneveld LLP

(57) ABSTRACT

A refrigerator includes an insulated cabinet having a sidewall with a passthrough opening through the sidewall. A resilient insulating member is disposed in the passthrough opening. The resilient insulating member includes flaps that form an airtight seal between the resilient insulating member and the passthrough opening. At least one utility line extends through an aperture in the resilient insulating member. The utility line may comprise fluid conduit, electrical line, or the like that operably connect one or more components through the sidewall of the cabinet.

18 Claims, 6 Drawing Sheets

(56) References Cited

U.S. PATENT DOCUMENTS 4,180,297 A * 12/1979 Abrams ..... F25D 23/065 16/2.2
4,186,945 A * 2/1980 Hahn ..... F16L 5/022 174/153 G
4,241,967 A * 12/1980 Collins ..... H01R 13/52 439/589
4,715,512 A * 12/1987 Buchser ..... F25D 23/064 220/592.1
4,805,293 A * 2/1989 Buchser ..... F25D 23/064 264/46.6
5,000,010 A * 3/1991 Powell ..... F25D 21/04 312/401
5,112,241 A * 5/1992 Chesnut ..... H01R 13/5202 439/273
5,238,299 A 8/1993 McKinney
5,248,196 A * 9/1993 Lynn ..... H01R 13/743 312/406
5,271,240 A * 12/1993 Detrick ..... F25D 17/042 62/268
5,317,924 A * 6/1994 Maack ..... G01L 19/0007 220/691
5,466,016 A * 11/1995 Briody ..... B60K 15/04 220/86.2
5,540,450 A * 7/1996 Hayashi ..... H01R 13/5205 174/152 G
5,941,619 A * 8/1999 Stieben ..... F25D 23/028 312/223.6
6,088,876 A * 7/2000 Daoud ..... F16L 5/10 16/2.2
6,211,464 B1 * 4/2001 Mochizuki ..... B60R 16/0222 16/2.1
6,224,179 B1 * 5/2001 Wenning ..... F25D 23/065 312/406
6,574,982 B1 6/2003 Wiseman et al.
6,768,058 B2 7/2004 Pallapothu
7,434,814 B2 10/2008 Kumakura et al.
7,442,884 B2 10/2008 Ball et al.
7,641,298 B2 * 1/2010 Hirath ..... F25D 23/065 312/401
7,762,634 B2 * 7/2010 Tenra ..... B32B 3/04 312/5
8,490,353 B2 7/2013 Beele
8,833,014 B2 9/2014 Beele
8,986,483 B2 3/2015 Cur et al.
9,407,078 B2 * 8/2016 Budagher ..... H02G 3/32
9,752,818 B2 * 9/2017 Naik ..... F25D 23/061
10,767,919 B2 * 9/2020 Naik ..... F25D 23/068
2002/0038492 A1 * 4/2002 Hashimoto ..... F16L 5/10 16/2.1
2002/0171207 A1 * 11/2002 Torii ..... H01R 13/5205 277/607
2005/0055889 A1 * 3/2005 Thaler ..... E04D 13/1476 52/58
2005/0235682 A1 * 10/2005 Hirai ..... F25D 23/062 62/440
2006/0076863 A1 * 4/2006 Echigoya ..... F16L 59/065 312/401
2006/0082073 A1 * 4/2006 Dorner ..... H02G 3/22 277/602
2007/0099502 A1 * 5/2007 Ferinauer ..... F25D 23/066 439/589
2008/0066949 A1 * 3/2008 Cloud ..... G02B 6/4471 174/153 G
2008/0309210 A1 * 12/2008 Luisi ..... F25D 23/064 312/406.2
2009/0056367 A1 * 3/2009 Neumann ..... F25D 29/005 62/449
2009/0324871 A1 * 12/2009 Henn ..... E04B 1/803 428/69
2011/0146330 A1 * 6/2011 Kuehl ..... F16L 37/26 62/389
2013/0047645 A1 * 2/2013 Kim ..... F25C 1/04 62/125
2013/0105495 A1 5/2013 Jung
2013/0256319 A1 10/2013 Kuehl et al.
2014/0190725 A1 * 7/2014 Baydoun ..... B60R 16/0222 174/153 G
2017/0130960 A1 * 5/2017 Nagano ..... F16L 7/02
2017/0138656 A1 * 5/2017 Pfeiffer ..... F25C 1/25
2020/0033049 A1 * 1/2020 Dherde ..... H02G 15/013

FOREIGN PATENT DOCUMENTS

JP 2001056284 A * 10/2000
KR 20020060371 A 7/2002
KR 20070010870 A 1/2007
WO 2006026145 A1 3/2006
WO 2017112114 A1 6/2017
WO WO-2018111235 A1 * 6/2018 ..... H02G 15/013

* cited by examiner

FLEXIBLE PASSTHROUGH INSULATION FOR VIS

BACKGROUND OF THE DISCLOSURE

Various vacuum insulated refrigerator cabinets have been developed. In some cases, it may be necessary to route utility lines through an insulated wall of refrigerator cabinet structures.

SUMMARY OF THE DISCLOSURE

One aspect of the present disclosure is a refrigerator comprising a vacuum insulated cabinet having a food storage space and an enlarged access opening permitting items to be placed in the food storage space and removed from the food storage space. The vacuum insulated cabinet includes a sidewall having inner and outer sides, and a passthrough opening extending between the inner and outer sides. A resilient insulating member is disposed in the passthrough opening. The resilient insulating member includes a plurality of outwardly-projecting flexible flaps engaging a surface of the passthrough opening, and forming an airtight seal between the resilient insulating member and the surface of the passthrough opening. The resilient insulating member includes an aperture extending through the resilient insulating member. The refrigerator further includes an evaporator assembly disposed inside of the sidewall, and a condenser assembly disposed outside of the sidewall. An at least one fluid conduit has an inner end that is fluidly connected to the evaporator assembly. The fluid conduit extends through the aperture of the resilient insulating member. The fluid conduit has an outer end fluidly connected to the condenser assembly.

Another aspect of the present disclosure is a method of routing a fluid conduit through a passthrough opening of a vacuum insulated cabinet of a refrigerator. The method includes providing a resilient insulating member having an aperture extending through the resilient insulating member. A pull sleeve is positioned in the aperture. The pull sleeve includes at least one transversely-extending pull structure at an end of the pull sleeve adjacent the aperture of the resilient insulating member. The method further includes positioning the resilient insulating member in a passthrough opening of a vacuum insulated cabinet of a refrigerator and pushing a fluid conduit through the central opening of the pull sleeve with the fluid conduit in tight contact with the opening of the pull sleeve while simultaneously pulling on the pull structure.

Another aspect of the present disclosure is an insulating assembly for sealing a passthrough opening through a sidewall of a vacuum insulated cabinet of a refrigerator. The insulating assembly includes a resilient insulating member having a plurality of flexible flaps extending around a periphery of the resilient insulating member. The resilient insulating member further includes at least one aperture extending through the resilient insulating member. A pull sleeve is disposed in the aperture. The pull sleeve includes a generally cylindrical opening therethrough defining an axis, and at least one pull structure extending transversely relative to the axis from an end of the pull sleeve. The resilient insulating member comprises a first material, and the pull sleeve comprises a second material that is significantly harder than the first material.

These and other features, advantages, and objects of the present disclosure will be further understood and appreciated by those skilled in the art by reference to the following specification, claims, and appended drawings.

BRIEF DESCRIPTION OF THE DRAWINGS

In the drawings:

FIG. 6;

FIG. 6;

FIG. 6.

Figure 1:
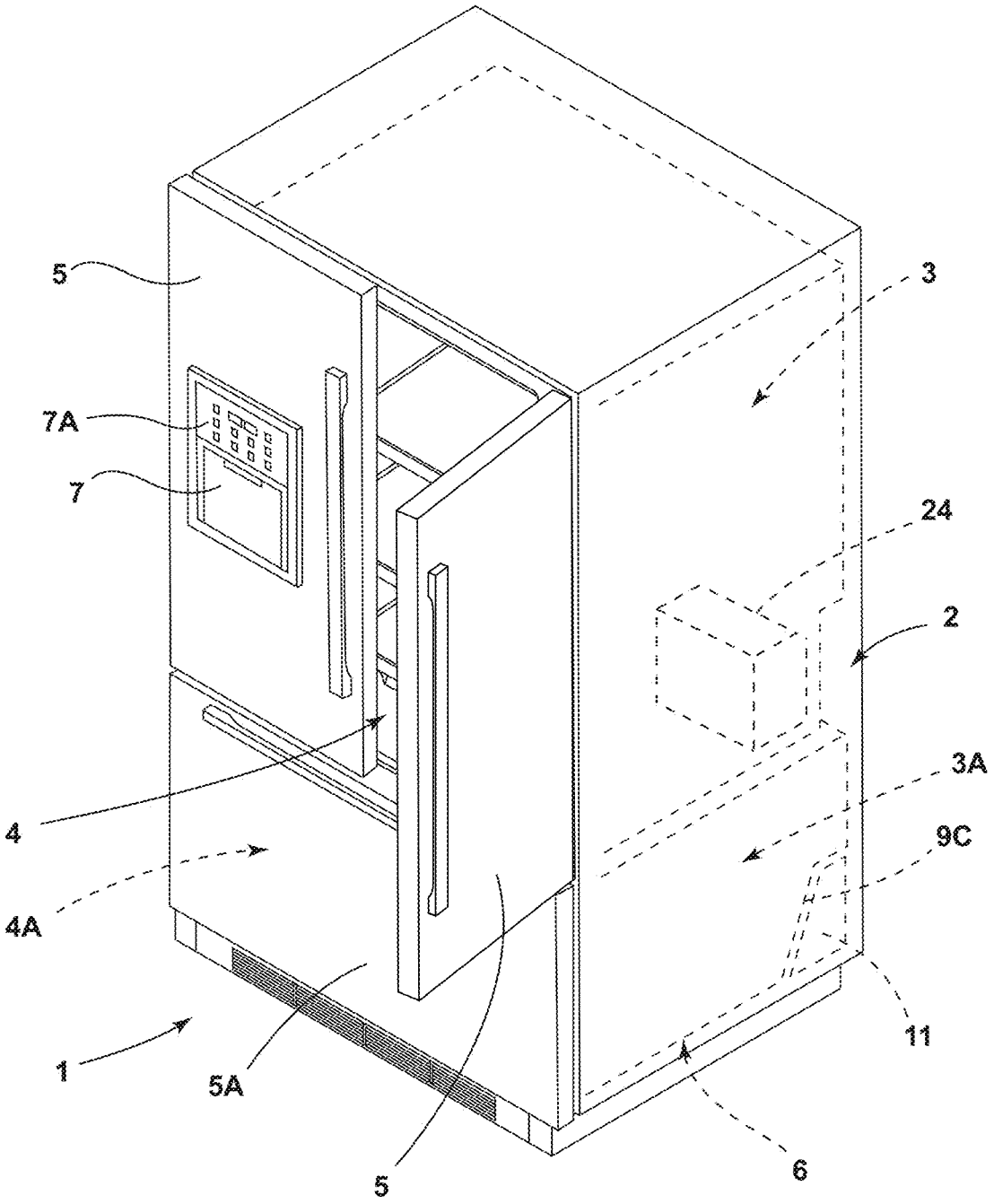
FIG. 1 is an isometric view of a refrigerator having a vacuum insulated cabinet according to one aspect of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to an insulated refrigerator structure. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With reference to FIG. 1, a refrigerator according to one aspect of the present disclosure includes a vacuum insulated cabinet 2 having a food storage space 3 that may be refrigerated. Vacuum insulated cabinet 2 optionally includes a second food storage space 3A for frozen food. The cabinet 2 includes an enlarged access opening 4 permitting items (e.g. consumable goods) to be placed in the food storage space 3 and removed from the food storage space 3. The refrigerator 1 may include at least one upper door 5 that is movably mounted to the cabinet 2 to selectively close off the access opening 4. An optional access opening 4A permits access to freezer space 3A. A drawer 6 having a front 5A may be movably mounted to the vacuum insulated cabinet 2 to provide access to freezer space 3A. At least one of the doors 5 may include a dispensing unit 7 for dispensing water and/or ice, and a user interface 7A that provides for user control of various refrigerator functions. The doors 5 and drawer 6 may be substantially similar to known refrigerator doors and drawers, and further description is therefore not believed to be required.

Figure 2:
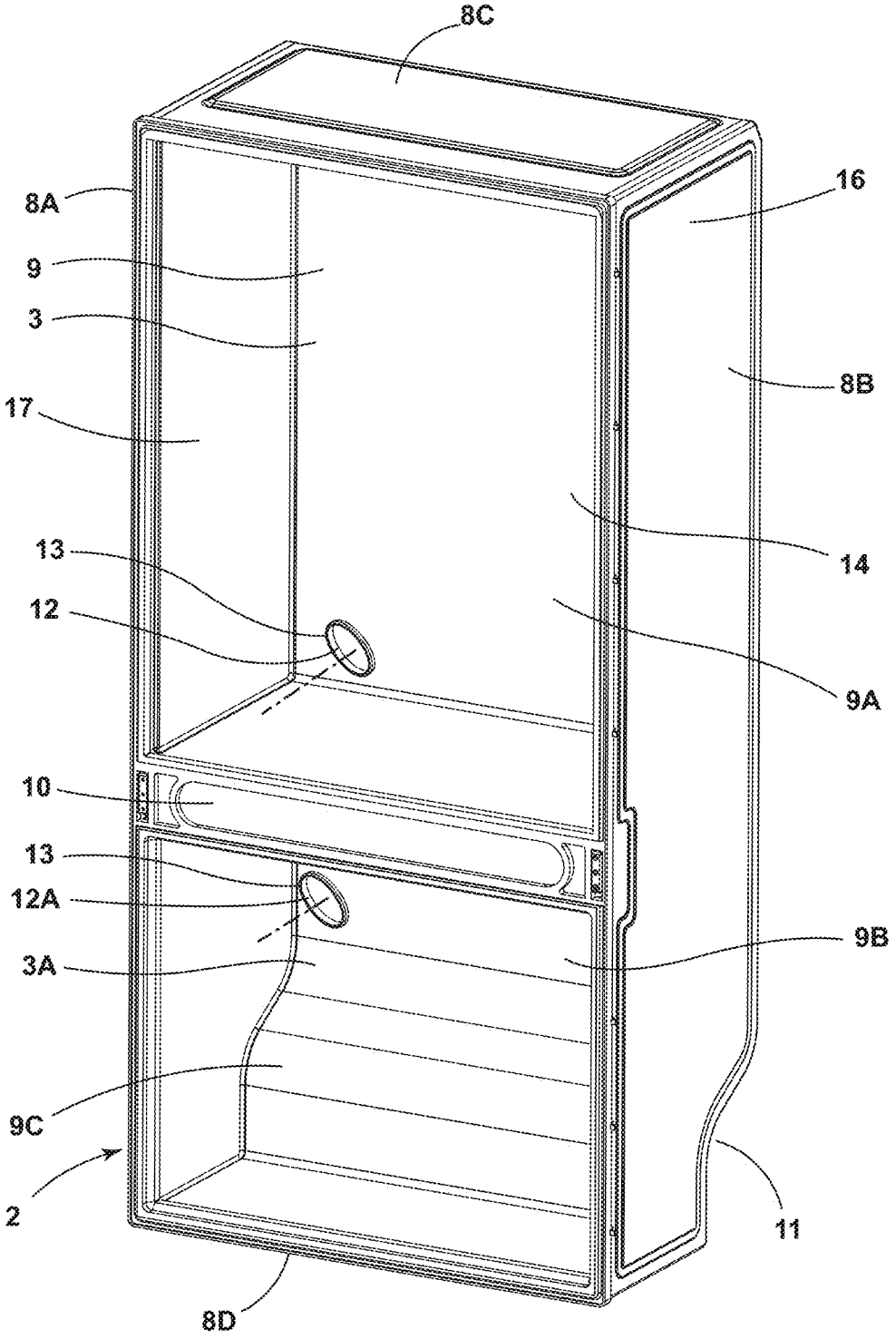
FIG. 2 is an isometric view of a refrigerator cabinet.

With further reference to FIG. 2, the vacuum insulated cabinet 2 includes upright sidewalls 8A and 8B, and horizontally extending upper and lower sidewalls 8C and 8D, respectively. An upright rear sidewall 9 of vacuum insulated cabinet 2 includes an upper portion 9A and a lower portion 9B that are separated by a horizontal divider structure 10. The rear sidewall 9 includes one or more passthrough openings such as upper and lower passthrough openings 12A and 12B, respectively, in upper and lower sidewall portions 9A and 9B, respectively. Lower sidewall 9B may include a forwardly-extending portion 9C forming a space 11 (see also FIG. 1) for various mechanical units (not shown) to be positioned outside of the food storage spaces 3 and 3A. Passthrough opening 12A and 12B are formed by passthrough surfaces 13, and the passthrough openings 12A and 12B extend between inner side 14 (FIG. 2) and outer side 15 (FIGS. 3 and 4) of rear sidewall 9. Inner and outer sides 14 and 15 of sidewall 9 generally face in opposite directions. The vacuum insulated cabinet 2 may comprise an outer wrapper 16 and inner liner 17 forming a vacuum space 18 that is substantially filled with porous filler material 19 (see also FIGS. 7-9). Alternatively, vacuum insulated cabinet 2 may comprise a vacuum insulated panel structure having a plurality of preformed vacuum core members or boards (not shown) disposed between wrapper 16 and liner 17.

The refrigerator 1 further includes a resilient insulating member 20 (FIGS. 3-6) that is disposed in the passthrough opening 12 when the vacuum insulated cabinet 2 is assembled. The resilient insulating member 20 includes a plurality of outwardly-projecting flexible flaps 22 (FIG. 5) engaging the passthrough surface 13 (see also FIGS. 7-9) and forming an airtight seal between the resilient insulating member 20 and the passthrough opening 12. The resilient insulating member 20 includes one or more apertures 25, 26, 27 (FIG. 5) extending through the resilient insulating member 20.

When assembled, refrigerator 1 further includes an evaporator assembly 23 (FIG. 3) that is disposed inside of inner side 14 (FIG. 2) of sidewall 9, and a condenser assembly 24 (FIG. 1) positioned outside of the outer side 15 of sidewall 9. A fluid conduit 28 (FIGS. 3 and 6) has an inner end 29A (FIG. 3) fluidly connected to the evaporator assembly 23, with the fluid conduit 28 extending through the aperture 25 of resilient insulating member 20. The fluid conduit 28 has an outer end 29B that is fluidly connected to condenser 24 as shown schematically in FIG. 3. A second fluid conduit such as drain tube 30 may extend through aperture 26 of resilient insulating member 20, and may include opposite ends 31A and 31B that are fluidly connected to evaporator assembly 23 and condenser 24, respectively. The evaporator assembly 23A (FIG. 4) for freezer space 3A may be fluidly connected to condenser 24 by fluid lines that are substantially identical to the fluid conduits 28 and 30 of FIG. 3. Evaporator assemblies 23 and 23A may be configured to cool spaces 3 and 3A in a manner that is generally known. It will be understood that evaporator assembly 23A may be connected to a separate condenser (not shown) rather than being connected to the same condenser 24 as evaporator assembly 23. Fluid conduits 28 and 30, evaporator assembly 23, and condenser 24 may function similarly to known units, such that a detailed discussion of the operation of these components is not believed to be necessary.

Figure 5:
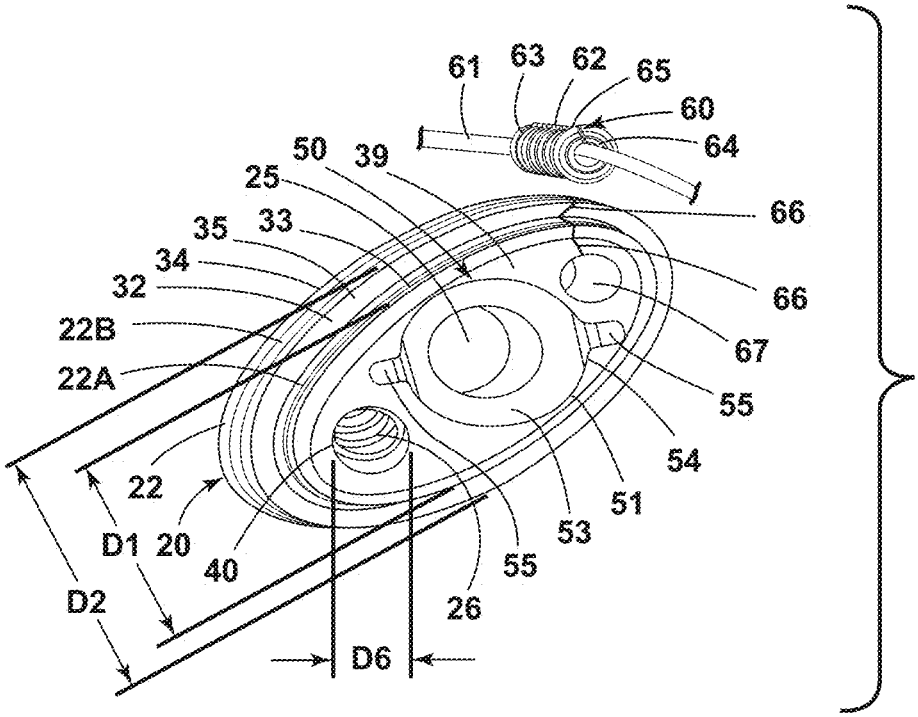
FIG. 5 is an exploded isometric view of an insulating passthrough assembly according to one aspect of the present disclosure.
Figure 6:
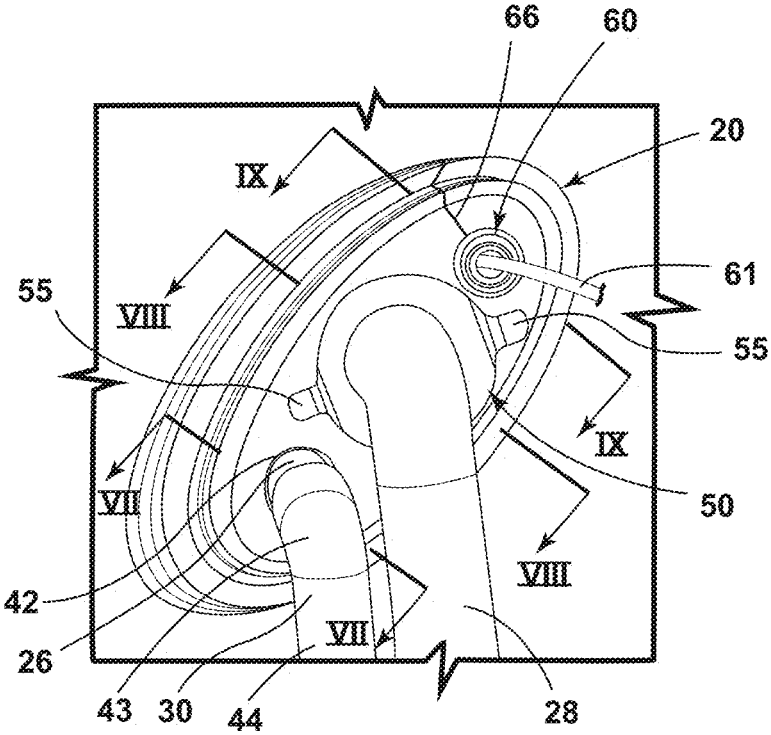
FIG. 6 is an isometric view of an insulating passthrough assembly installed in an opening of a refrigerator cabinet.
Figure 7:
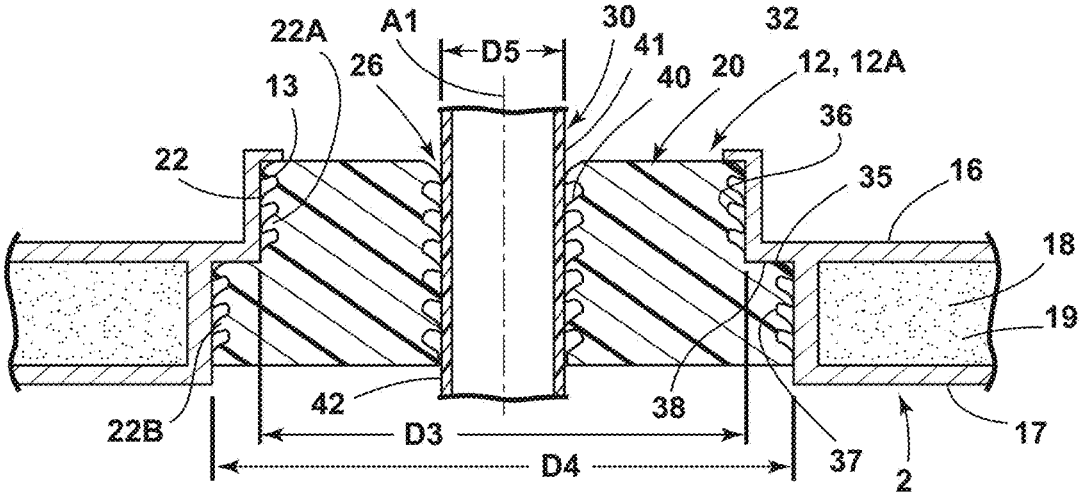
FIG. 7 is a fragmentary cross-sectional view taken along the line VII-VII.

With reference to FIG. 5, resilient insulating member 20 includes a body 32 that may be molded from a suitable material such as flexible PVC having a durometer of about 60 to about 70. However, body 32 may be made from virtually any suitable material as required for a particular application. Body 32 and passthrough opening 12 may be generally oblong in shape (e.g. oval) to accommodate the openings 25, 26, 27 as shown in FIGS. 6 and 7. Alternatively, the passthrough opening 12 and resilient insulating member 20 may be circular, or virtually any other shape as required for a particular application. The body 32 of resilient insulating member 20 preferably includes a first portion 33 having a dimension "D1," a second portion 34 having a second dimension "D2," and an annular step surface 35 that extends transversely between the first and second portions 33 and 34, respectively. First portion 33 generally corresponds to a first portion 36 (FIG. 7) of passthrough opening 12, and second portion 34 of body 32 generally corresponds to a second portion 37 of passthrough opening 12. Step surface 35 of body 32 generally corresponds to step 38 of passthrough opening 12. As shown in FIG. 5, the dimension D1 may be substantially smaller than the dimension D2.

First portion 33 of body 32 includes one or more flexible flaps 22A, and second portion 34 of body 32 includes a plurality of flexible flaps 22B. Flaps 22A and 22B are preferably formed integrally with the body 32 and extend around a periphery of body 32. Flaps 22A and 22B deform elastically when resilient insulating member 20 is positioned in passthrough opening 12 due to engagement of flaps 22A and 22B with passthrough surface 13 to thereby form an airtight seal between resilient insulating member 20 and passthrough opening 12 of vacuum insulated cabinet 2. When resilient insulating member 20 is installed (FIG. 7), the step surface 35 of body 32 may abut the step surface 38 of passthrough opening 12. Passthrough opening 12 defines internal dimensions "D3" and "D4" (FIG. 7) that are preferably somewhat smaller than the corresponding dimensions D1 and D2, respectively, of body 32, such that the flaps 22A and 22B of resilient insulating member 20 form an interference fit in passthrough opening 12.

With reference to FIGS. 5-7, aperture 26 through body 32 of resilient insulating member 20 includes a plurality of inwardly-extending annular flaps or ridges 40 that engage and seal against outer surface 41 of second fluid conduit 30 when fluid conduit 30 is positioned in second aperture 26. An outer diameter "D5" of second fluid conduit 30 is preferably somewhat larger than a diameter "D6" (FIG. 5) of aperture 26 prior to installation of fluid conduit 30 in second opening 26 to thereby form an interference fit between the annular ridges 40 and outer surface 41 of second fluid conduit 30 that flexibly deforms annular ridges 40. With reference to FIG. 6, the second fluid conduit 30 may comprise a fitting 42 that extends through aperture 26, an elbow 43 that is connected to the fitting 42, and a straight tubular section 44. It will be understood that the configuration of the fluid conduit 30 may vary as required for a particular application, and the fitting 42, elbow 43, and straight section 44 are merely an example of one possible configuration. The second fluid conduit 30 may comprise polymer, metal, or other suitable material.

Figure 8:
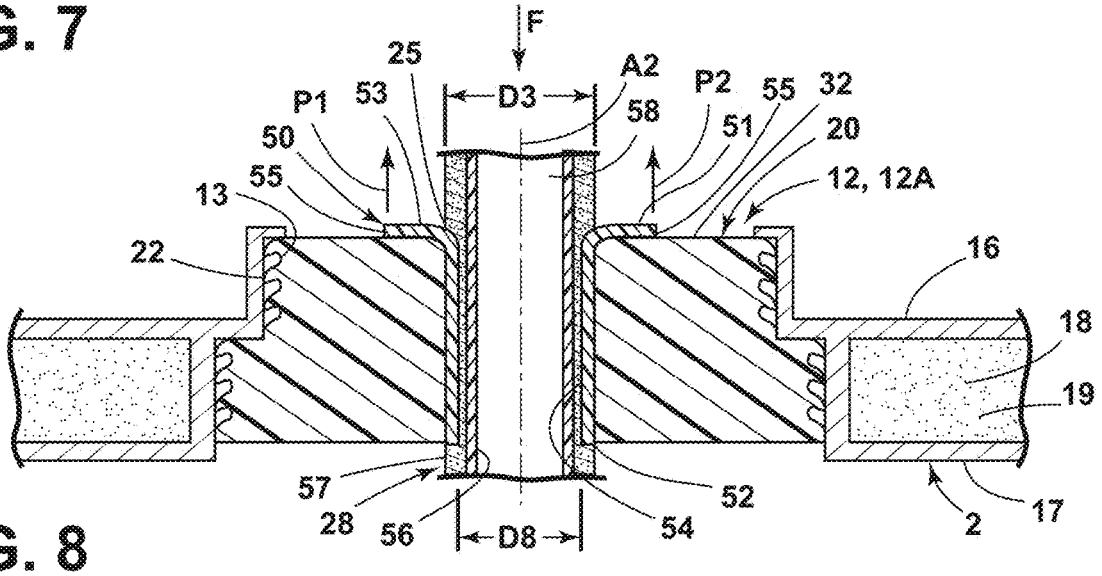
FIG. 8 is a fragmentary cross-sectional view taken along the line VIII-VIII.

With reference to FIGS. 5, 6, and 8, a pull sleeve 50 may be positioned in aperture 25. Pull sleeve 50 may optionally comprise a polymer material that is significantly harder than the material of resilient insulating member 20, and having a relatively low coefficient of friction. Pull sleeve 50 includes first and second opposite ends 51 and 52, respectively. First end 51 may include a flared portion 53 having a gradually increased diameter relative to a cylindrical central portion 54 extending between the opposite ends 51 and 52. Pull sleeve 50 also includes pull structures such as tabs 55 that may be integrally formed at first end 51. The pull tabs 55 generally extend outwardly transverse to an axis "A2" of pull sleeve 50, and may extend adjacent or abutting an outer end surface 39 of body 32 of resilient insulating member 20.

Referring again to FIG. 8, fluid conduit 28 may comprise a tubular inner member 56 that may be made from a relatively rigid material (e.g. polymer or metal). The fluid conduit 28 may further include a resilient foam outer portion or sleeve 57. As shown in FIG. 8, an outer dimension "D7" of foam sleeve 57 may be larger than an inner diameter "D8" of opening 58 of pull sleeve 50 such that the foam sleeve 57 is compressed in the region where the foam sleeve 57 contacts cylindrical surface 54 of pull sleeve 50. Pull sleeve 50 may be insert molded into resilient insulating member 20, or pull sleeve 50 may be fabricated separately and inserted into aperture 25 of resilient insulating member 20. As discussed in more detail below, during assembly, a force "F" is applied to the fluid conduit 28, and a force (represented by arrows "P1" and "P2") is applied to the pull tabs 55 of pull sleeve 50 to thereby compress the foam sleeve 57 while fluid conduit 28 is inserted into the opening 50 of pull sleeve 50.

Figure 9:
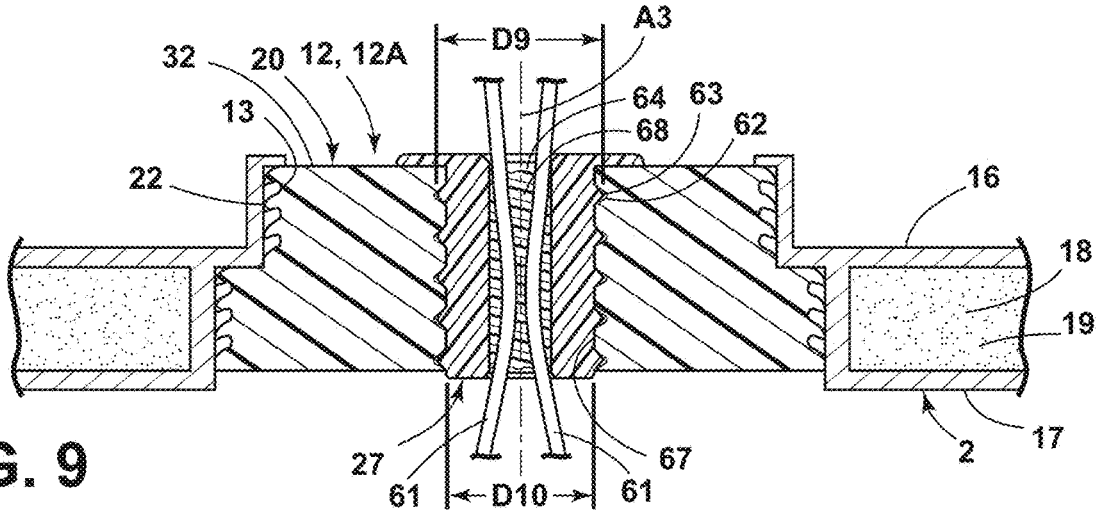
FIG. 9 is a fragmentary cross-sectional view taken along the line IX-IX.

With further reference to FIGS. 5, 6, and 9, a wire grommet 60 may be positioned in third aperture 27 of resilient insulating member 20 to permit pass-through of one or more electrical lines 61. Wire grommet 60 includes a generally cylindrical outer surface 62 having a plurality of raised ridges 63, and a cylindrical passageway 64 that receives electrical wires 61 when assembled. A cut 65 extends between the outer surface 62 and 64. Wire grommet 60 may be made of a polymer material having sufficient flexibility to permit the wire grommet 60 to be opened along the cut 65 whereby electrical wires 61 can be inserted into the passageway 64. Sealant 68 may (optionally) be positioned in passageway 64 around wires 61 to provide an airtight seal. Sealant 68 may comprise silicone or other suitable material. Body 32 of resilient insulating member 62 includes a cut 66 that extends from cylindrical surface 67 of aperture 27 to the outer portions 33, 34, and 35 of body 32 of resilient insulating member. During assembly, the wire grommet 60 can be inserted into opening 27 by opening the cut 66 to thereby permit the wire grommet 60 to be inserted into aperture 27. An outer diameter "D9" of wire grommet 60 is preferably somewhat greater than an inner diameter "D10" of aperture 27 such that ridges 63 deform inner surface 67 of aperture 27 to form an airtight fit.

Figure 9A:
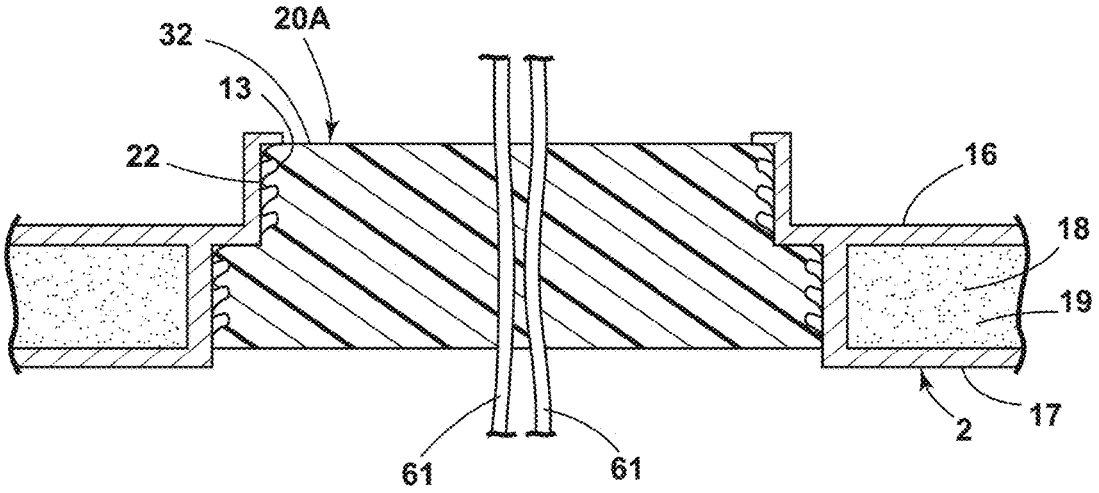
FIG. 9A is a fragmentary cross-sectional view showing an alternative wire passthrough.

With reference to FIG. 9A, wire grommet 60 may be eliminated, and the wire passthrough may be integrated as/with a resilient insulating member 20A. For example, the material of the resilient insulating member 20A may be molded around electrically conductive elements such as electrical lines (wires) 61 to encapsulate wires 61 to form an airtight seal. For example, electrical lines 61 may be positioned in a mold cavity of a mold tool (not shown) prior to filling the mold cavity with uncured flowable resilient material. After the resilient material cures (solidifies), the resilient insulating member 20A and wires 61 can be removed from the mold cavity. It will be understood that electrical lines 61 may comprise a suitable conductive inner material (e.g. copper) that is surrounded by electrically insulating material. Thus, the resilient material of resilient insulating member 20A may contact the electrically insulating outer material of electrical lines 61 and form an airtight seal therewith.

During assembly, the fluid conduit 28 and foam insulation sleeve 57 may be first inserted into aperture 25 through opening 58 of pull sleeve 50. Force "P1" and "P2" may be applied to tabs 55 while an axial force "F" is applied to conduit 28. The fluid conduit 28 may be positioned in the opening 58 of pull sleeve 50 before or after the resilient insulating member 20 is positioned in passthrough opening 12, the fluid conduit 28 is preferably positioned in opening 58 of pull sleeve 50 before resilient insulating member 20 is positioned in passthrough opening 12. During assembly, the second fluid conduit 30 is positioned in aperture 26 (FIGS. 5, 6, and 7) with the ridges 40 tightly engaging the second fluid conduit 30 to form an airtight seal. The second fluid conduit 30 may be inserted into aperture 26 either before or after fluid conduit 28 is inserted into opening 58 of pull sleeve 50, and the second fluid conduit 30 may be inserted into aperture 26 either before or after resilient insulating member 20 is positioned in passthrough opening 12 of cabinet 2. However, second fluid conduit 30 is preferably positioned in aperture 26 of resilient insulating member 20 before resilient insulating member 20 is positioned in passthrough opening 12 of vacuum insulated cabinet 2.

During assembly, electrical lines 61 are positioned in wire grommet 60 by opening the wire grommet 60 along cut 65 as described above, and the wire grommet 60 is then positioned in aperture 27 by opening resilient insulating member 20 along cut 66 (FIG. 5). Sealant 68 may (optionally) be positioned in passageway 64 of grommet 60 around wires 61 to provide an airtight seal. The wire grommet 60 and wires 61 may be positioned in aperture 27 of resilient insulating member 20 in any sequence relative to the assembly of fluid conduits 28 and 30, and before or after resilient insulating member 20 is positioned in passthrough opening 12 of vacuum insulated cabinet 2. Alternatively, as discussed above in connection with FIG. 9A, wires 61 may be molded into the material of the resilient insulating member 20A.

Figure 3:
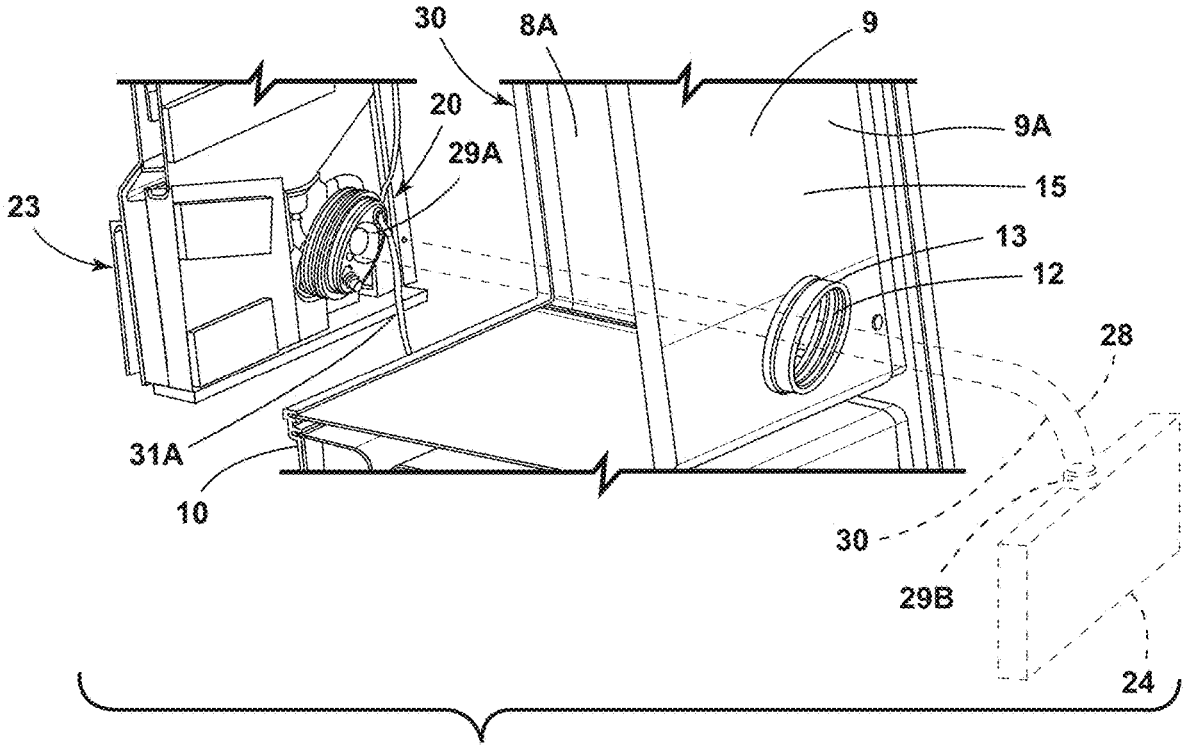
FIG. 3 is a partially fragmentary exploded view of a portion of a refrigerator cabinet.
Figure 4:
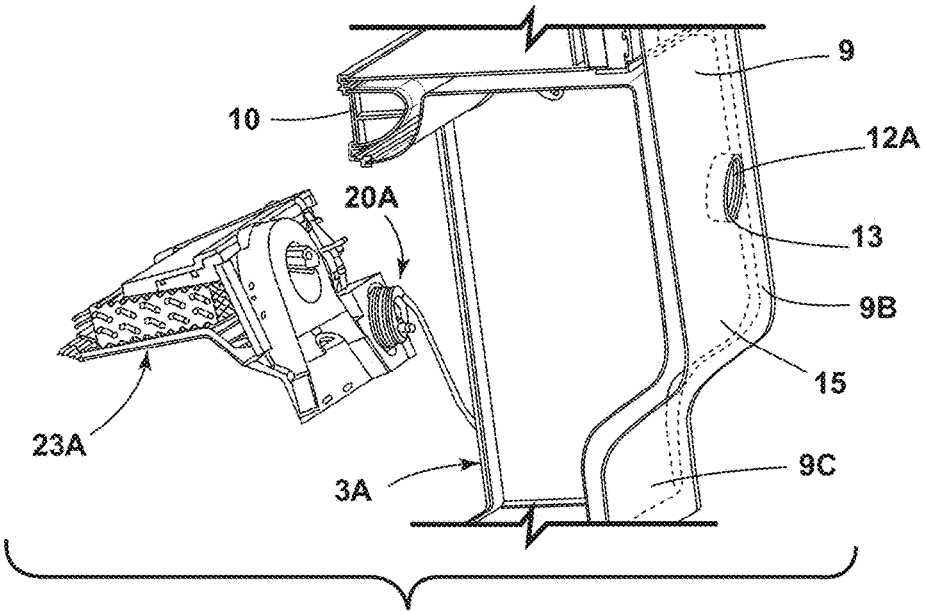
FIG. 4 is a partially fragmentary exploded view of a portion of a refrigerator cabinet.

With reference to FIG. 3, the resilient insulating member 20 may be initially secured to evaporator assembly 23 with fluid conduits 28 and 30 and electrical wires 61 passing through the resilient insulating member 20, and the fluid conduits 28 and 30 and electrical lines 61 may then be extended through passthrough opening 12. The evaporator assembly 23 and resilient insulating member 20 are then positioned on or adjacent inner side 14 of sidewall 9, and the resilient insulating member 20 is positioned in the passthrough opening 12. As discussed above, positioning the resilient insulating member 20 in passthrough opening 12 causes the flaps 22A and 22B of body 32 to deform and create an airtight seal around the passthrough opening 12. Force (e.g. arrows P1 and P2, FIG. 8) may be applied to the pull tabs 55 of pull sleeve 50, and a force F (FIG. 8) may be applied to the fluid conduit 28 as required to properly position fluid conduit 28 in pull sleeve 50. If refrigerator 1 includes a freezer compartment 3A, an evaporator assembly 23A and resilient insulating member 20A may be installed to sidewall 9 with fluid and electrical conduits extending through passthrough opening 12A in substantially the same manner as described above.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A refrigerator comprising:

a vacuum insulated cabinet having a food storage space and an enlarged access opening permitting items to be placed in the food storage space and removed from the food storage space, the vacuum insulated cabinet including a sidewall having inner and outer sides, and a passthrough opening extending between the inner and outer sides, the passthrough opening having a passthrough surface that is transverse to the inner and outer sides;

a resilient insulating member comprising a resilient material, wherein the resilient insulating member is disposed in the passthrough opening, the resilient insulating member including a plurality of outwardly-projecting flexible flaps extending completely around an outside of the resilient insulating member and flexing and engaging the passthrough surface of the passthrough opening and forming an airtight seal between the resilient insulating member and the passthrough surface of the passthrough opening, the resilient insulating member further including an aperture extending through the resilient insulating member;

an evaporator assembly disposed inside of the sidewall;

a condenser assembly disposed outside of the sidewall; and at least one conduit having an inner end fluidly connected to the evaporator assembly and extending through the aperture of the resilient insulating member, the fluid conduit having an outer end fluidly connected to the condenser assembly, wherein: the surface of the passthrough opening includes a first portion having a first dimension, a second portion having a second dimension, and an annular step surface extending between the first and second portions; wherein: the plurality of outwardly-projecting flexible flaps include a first portion including a first plurality of outwardly-projecting flexible flaps engaging the first portion of the passthrough surface, and a second portion including a second plurality of outwardly-projecting flexible flaps engaging the second portion of the passthrough surface.

2. The refrigerator of claim 1, wherein:

the resilient insulating member includes a step surface extending between the first and second portions of the resilient insulating member, wherein the step surface of the resilient insulating member engages the annular step surface of the passthrough surface of the passthrough opening.

3. The refrigerator of claim 1, wherein:

the aperture through the resilient insulating member comprises a first aperture, the resilient insulating member including a second aperture extending through the resilient insulating member; and including:

a drain tube extending through the second aperture.

4. The refrigerator of claim 3, wherein:

the second aperture includes a plurality of inwardly-extending flexible annular flaps engaging the drain tube and forming an airtight seal with the drain tube.

5. The refrigerator of claim 4, wherein:

the resilient insulating member includes a third aperture and a cut extending between the third aperture and an outer surface of the resilient insulating member whereby the resilient insulating member can be flexed in the region of the cut to open the cut; and including:

a wire grommet disposed in the third aperture; and an electrical line extending through the wire grommet.

6. The refrigerator of claim 5, wherein:

the wire grommet includes a central passageway and the electrical line is disposed in the central passageway, the wire grommet including an outer surface having a plurality of outwardly-projecting annular ridges engaging a surface of the resilient insulating member forming the third aperture, the wire grommet further including a cut extending between the central passageway and the outer surface of the wire grommet whereby the wire grommet can be flexed open at the cut to permit insertion of electrical lines into the central passageway of the wire grommet.

7. The refrigerator of claim 1, including:

at least one electrical line extending through the resilient insulating member, wherein the resilient material of the resilient insulating member contacts the electrical line and forms an airtight seal around the electrical line.

8. The refrigerator of claim 1, wherein:

the resilient insulating member comprises flexible PVC having a durometer of about 60 to about 70.

9. The refrigerator of claim 1, wherein:

the sidewall of the vacuum insulated cabinet comprises a flange extending around the passthrough opening and projecting outwardly from the outer side of the sidewall;

at least one of the flexible annular flaps of the resilient insulating member engages an inner surface of the flange extending around the passthrough opening.

10. The refrigerator of claim 9, wherein:

an inner surface of the flange extending around the passthrough opening is oblong, and the surface of the passthrough opening is oblong.

11. A refrigerator, comprising:

a substantially rigid pull sleeve disposed in the aperture of the resilient insulating member, the pull sleeve comprising a material that is substantially more rigid than the resilient material of the resilient insulating member; and wherein:

the fluid conduit extends through the pull sleeve, the fluid conduit comprising a tube and a compressible insulating sleeve surrounding the tube, wherein the compressible insulating sleeve is compressed due to contact with the pull sleeve to form an airtight seal;

a vacuum insulated cabinet having a food storage space and an enlarged access opening permitting items to be placed in the food storage space and removed from the food storage space, the vacuum insulated cabinet including a sidewall having inner and outer sides, and a passthrough opening extending between the inner and outer sides;

a resilient insulating member comprising a resilient material, wherein the resilient insulating member is disposed in the passthrough opening, the resilient insulating member including a plurality of outwardly-projecting flexible flaps engaging a surface of the passthrough opening and forming an airtight seal between the resilient insulating member and the surface of the passthrough opening, the resilient insulating member further including an aperture extending through the resilient insulating member;

an evaporator assembly disposed inside of the sidewall;

a condenser assembly disposed outside of the sidewall; and at least one conduit having an inner end fluidly connected to the evaporator assembly and extending through the aperture of the resilient insulating member, the fluid conduit having an outer end fluidly connected to the condenser assembly.

12. The refrigerator of claim 11, wherein:

the pull sleeve includes a pair of tabs extending transversely from a first end of the pull sleeve, wherein the tabs are configured to provide a grip feature;

the first end of the pull sleeve includes an outwardly-extending annular flare configured to guide the fluid conduit through the pull sleeve during assembly.

13. A method of routing a fluid conduit through a passthrough opening of a vacuum insulated cabinet of a refrigerator, the method comprising:

providing a resilient insulating member having an aperture extending through the resilient insulating member;

positioning a pull sleeve in the aperture, the pull sleeve including at least one transversely-extending pull structure at an end of the pull sleeve adjacent the aperture of the resilient insulating member;

pushing a fluid conduit through a central opening of the pull sleeve with the fluid conduit in tight contact with the opening of the pull sleeve while simultaneously pulling on the pull structure;

positioning the resilient insulating member in a passthrough opening of a vacuum insulated cabinet of a refrigerator.

14. The method of claim 13, wherein:

the pull structure comprises a pair of tabs extending in opposite directions from an end of the pull sleeve; and including:

simultaneously pulling on the tabs while pushing the fluid conduit through a central opening of the pull sleeve.

15. The method of claim 13, wherein:

the resilient insulating member includes a plurality of outwardly-projecting annular flaps; and including:

forming an airtight seal between the resilient insulating member and the passthrough opening by causing the plurality of outwardly-projecting annular flaps of the resilient insulating member to flex and engage a surface of the passthrough opening by inserting the resilient insulating member into the passthrough opening.

16. An insulating assembly for sealing a passthrough opening through a sidewall of a vacuum insulated cabinet of a refrigerator, the insulating assembly comprising:

a resilient insulating member including a plurality of outwardly-projecting flexible flaps extending around a periphery of the resilient insulating member, the resilient insulating member further including at least one aperture extending through the resilient insulating member;

a pull sleeve disposed in the aperture, the pull sleeve including a generally cylindrical central opening therethrough defining an axis, and at least one pull structure extending transversely relative to the axis from an end of the pull sleeve;

wherein the resilient insulating member comprises a first material, and the pull sleeve comprises a second material that is significantly harder than the first material.

17. The insulating assembly of claim 16, wherein:

the aperture comprises a first aperture, and the resilient insulating member includes a second aperture therethrough having a plurality of inwardly-extending resilient ridges configured to form an airtight seal around a cylindrical tube disposed in the second aperture.

18. The insulating assembly of claim 17, wherein:

the resilient insulating member includes a third aperture therethrough; and including:

a wire grommet disposed in the third aperture, the wire grommet having a generally tubular configuration with a central passageway therethrough, the wire grommet including a cut through a sidewall of the wire grommet whereby the wire grommet can be flexed open at the cut to permit the wire grommet to be inserted into the central passageway.

* * * * *